US009795232B2

(12) United States Patent
Holbrook et al.

(10) Patent No.: US 9,795,232 B2
(45) Date of Patent: Oct. 24, 2017

(54) HOURGLASS PILLOW WITH INTERNAL BAFFLE

(71) Applicant: Standard Fiber, LLC, Burlingame, CA (US)

(72) Inventors: Russ Holbrook, Matthews, NC (US); W. Alexander Gray, III, Whitefish, MT (US)

(73) Assignee: STANDARD FIBER, LLC, Burlingame, CA (US)

( * ) Notice: Subject to any disclaimer, the term of this patent is extended or adjusted under 35 U.S.C. 154(b) by 0 days.

(21) Appl. No.: 14/878,117

(22) Filed: Oct. 8, 2015

(65) Prior Publication Data

US 2017/0099967 A1 Apr. 13, 2017

(51) Int. Cl.
*A47G 9/10* (2006.01)

(52) U.S. Cl.
CPC ..... *A47G 9/10* (2013.01)

(58) Field of Classification Search
CPC ..... A47G 2009/1018; A47G 9/10; A47G 9/1009; A47G 9/1027; A47G 9/1045; A47G 9/1072; A47G 9/109; A61G 13/121; A61G 7/072; A61G 7/0755; A47C 20/021
USPC ..... D6/601
See application file for complete search history.

(56) References Cited

U.S. PATENT DOCUMENTS 1,206,775 A * 11/1916 Everts ..... A47G 9/10 5/645
1,334,901 A 3/1920 Higdon
1,876,591 A 9/1932 Bawden
2,805,428 A * 9/1957 Buchman ..... A47G 9/10 5/645
3,283,343 A * 11/1966 Worcester ..... A47C 27/081 5/249
3,411,164 A * 11/1968 Sumergrade ..... A47G 9/10 5/644
3,616,470 A 11/1971 Young et al.
(Continued)

FOREIGN PATENT DOCUMENTS

DE 8813059 U1 2/1989
DE 4423570 A1 1/1996
DE 29802897 U1 4/1998

OTHER PUBLICATIONS

U.S. Appl. No. 14/590,550, filed Jan. 6, 2015, Holbrook et al., "Mattress Pad with Removable Insert".
(Continued)

*Primary Examiner* — Eric Kurilla
(74) *Attorney, Agent, or Firm* — Levenfeld Pearlstein, LLC

(57) ABSTRACT

A pillow cover includes first and second panels joined to one another at front and rear edges to form upper and lower surfaces and side panels joined to the first and second panels at their respective peripheries. The side panels sides each have enlarged end portions with a thinning middle section to define an hourglass shape. The enlarged end portions having a major dimension. A baffle panel is joined to the first and second panels and extends between the side panels. The baffle panel has a height dimension less than the major dimension. The first and second panels, the side panels and the baffle panel define two continuous internal volumes. The baffle panel maintains the pillow in an hourglass shape. The side panels are symmetrical front to back. A filled pillow having an hourglass shape is also disclosed.

12 Claims, 3 Drawing Sheets

(56) References Cited

U.S. PATENT DOCUMENTS 4,007,503 A * 2/1977 Watkin ..... A47G 9/10 5/490
4,069,526 A 1/1978 Deikel
4,445,241 A 5/1984 Ender et al.
4,549,323 A 10/1985 Brockhaus
4,665,575 A 5/1987 Raught
4,887,326 A 12/1989 O'Brien et al.
4,955,095 A 9/1990 Gerrick
4,961,238 A 10/1990 Limb et al.
D312,186 S * 11/1990 Goguen ..... D6/601
4,969,223 A 11/1990 Yamaguchi
D319,751 S * 9/1991 Hoff ..... D6/601
5,109,559 A 5/1992 West
5,144,911 A 9/1992 Moore et al.
5,163,194 A 11/1992 Dixon
5,216,771 A * 6/1993 Hoff ..... A47C 20/025 5/490
5,221,273 A 6/1993 Graham
5,257,429 A 11/1993 Genis
5,274,865 A 1/1994 Takehashi
5,388,296 A 2/1995 Mansour
5,488,746 A 2/1996 Hudson
5,557,815 A * 9/1996 Mintz ..... A47G 9/10 297/223
5,608,936 A 3/1997 Nomura
5,745,940 A 5/1998 Roberts et al.
5,916,088 A 6/1999 Gueli
6,032,308 A 3/2000 Chuang
6,101,653 A 8/2000 England
6,237,171 B1 5/2001 Allen
D448,229 S 9/2001 Su et al.
6,408,468 B1 6/2002 Comfort
6,428,564 B1 8/2002 Ferguson
6,523,354 B1 2/2003 Tolbert
6,760,935 B1 7/2004 Burton et al.
6,760,937 B1 7/2004 Ou
D504,269 S 4/2005 Faircloth
6,988,286 B2 1/2006 Schecter et al.
7,066,897 B2 6/2006 Huang
7,100,223 B1 9/2006 Anthony
7,107,638 B2 9/2006 Wilson
7,143,457 B2 12/2006 Macdonald
7,152,263 B1 * 12/2006 Delfs ..... A47G 9/10 5/636
7,191,483 B2 3/2007 Hochschild
7,370,377 B2 5/2008 Landry
7,461,421 B1 12/2008 Faircloth et al.
7,588,291 B2 9/2009 Gold et al.
D604,550 S 11/2009 Carter
7,744,153 B2 6/2010 Gentry et al.
D634,959 S * 3/2011 McNaughton ..... D6/601
8,307,482 B2 11/2012 Gladney et al.
8,393,025 B2 3/2013 Crispino et al.
8,474,079 B1 7/2013 Gangitano
8,567,347 B2 10/2013 Leahy et al.
8,646,134 B1 2/2014 Alletto, Jr.
8,707,482 B1 4/2014 Ramthun
8,745,793 B2 6/2014 Bensoussan
8,813,276 B2 8/2014 Lee et al.
8,887,332 B2 11/2014 Alletto et al.
D721,519 S * 1/2015 Gray, III ..... D6/601
8,978,185 B1 3/2015 Holbrook et al.
9,167,922 B1 10/2015 Holbrook et al.
9,167,923 B1 10/2015 Holbrook
2002/0088057 A1 * 7/2002 Wassilefsky ..... A61G 7/0755 5/648
2003/0005521 A1 * 1/2003 Sramek ..... A47C 20/021 5/648
2003/0106156 A1 6/2003 Long
2004/0123392 A1 7/2004 Stewart, III et al.
2004/0187210 A1 9/2004 Hickman
2004/0200003 A1 10/2004 Kuo
2005/0172410 A1 8/2005 Huang
2005/0193490 A1 9/2005 Macdonald
2006/0016011 A1 1/2006 Berg
2006/0075562 A1 4/2006 Digirolamo
2006/0130235 A1 6/2006 Wilson
2007/0000053 A1 1/2007 Yang
2007/0220676 A1 9/2007 Lamstein et al.
2008/0016621 A1 1/2008 Chung et al.
2008/0092297 A1 * 4/2008 Davis ..... A47C 20/021 5/648
2008/0235877 A1 10/2008 Murray et al.
2008/0244832 A1 10/2008 Kuo
2008/0250566 A1 * 10/2008 Brogan ..... A47G 9/10 5/645
2009/0001801 A1 1/2009 Gold et al.
2009/0139034 A1 6/2009 Maarbjerg
2009/0151072 A1 6/2009 Jones, III
2009/0199342 A1 * 8/2009 Delfs ..... A47G 9/10 5/645
2010/0005594 A1 1/2010 Rancourt et al.
2010/0154122 A1 6/2010 Crispino et al.
2010/0229307 A1 9/2010 Sato
2010/0235992 A1 9/2010 Bensoussan
2010/0237082 A1 9/2010 Fernandez
2011/0173754 A1 * 7/2011 Calder ..... A47G 9/1027 5/644
2012/0005833 A1 1/2012 Waters et al.
2012/0079659 A1 4/2012 Loos
2012/0227185 A1 9/2012 Batiste et al.
2013/0031723 A1 2/2013 Parnham
2014/0000035 A1 * 1/2014 Berg ..... A47G 9/10 5/636
2014/0020184 A1 * 1/2014 Loth ..... A47G 9/109 5/640
2014/0033438 A1 2/2014 Chen
2014/0096323 A1 4/2014 Alletto
2014/0196214 A1 7/2014 DuPre
2014/0196216 A1 7/2014 Weitzel et al.
2014/0352069 A1 * 12/2014 Verde Sanchez ..... A61G 7/072 5/636
2015/0040324 A1 2/2015 Dungan
2015/0089744 A1 4/2015 Moses
2015/0282647 A1 * 10/2015 Hall ..... A47G 9/10 5/636
2016/0051431 A1 * 2/2016 Staats ..... A61G 7/072 128/845

OTHER PUBLICATIONS

International Search Report issued by ISA/EPO in connection with PCT/US2016/041746 dated Oct. 25, 2016.

* cited by examiner

HOURGLASS PILLOW WITH INTERNAL BAFFLE

BACKGROUND

A pillow typically includes an outer layer or cover, such as a pillow shell, generally made of a fabric material that defines an internal space configured to house a padding or filler material. Most pillow are generally rectangular in shape when viewed from the top or bottom and have an arcuate or slightly bulging profile when viewed from the side, or in cross-section.

Other pillows may have specific shapes, such as recesses or troughs when viewed in cross-section. However, in order to achieve such shapes, the pillows are typically filled with a one piece, e.g., solid block foam element or other material having that particular shape. While such "shaped" pillows are common and in widespread use, they do not have the typical comfort level of a loosely filled pillow, such as a pillow filled with a fiber or feather fill.

Fiber or filled pillows may take a particular shape by virtue of the shape of the pillow shell. However, the fill in filled pillows will shift and may collect in or two areas such that the pillow loses the desired shape, such that the pillow may not provide the support or level of comfort desired.

Accordingly, there is a need for a filled pillow that has a desired, non-rectangular shape. Desirably, such a pillow is configured such that in use, the fill remains in a desired area or volume of the pillow.

SUMMARY

A pillow includes first and second panels joined to one another at front and rear edges to form upper and lower surfaces and side panels joined to the first and second panels at their respective peripheries. The side panels sides each have enlarged end portions with a thinning middle section to define an hourglass shape. The enlarged end portions have a major dimension.

A baffle panel is joined to the first and second panels and extends between the side panels. The baffle panel has a height dimension less than the major dimension. In an embodiment the pillow includes a fill material, such as a polyester fill. The baffle panel maintains the filled pillow in a desired, non-rectangular shape, such an hourglass shape, which has been found to provide ergonomic benefits.

The first and second panels, the side panels and the baffle panel define two continuous internal volumes. The baffle panel maintains the pillow in an hourglass shape. The baffle panel is spaced from the side panels so as to define spaces between the baffle panel and the side panels. The spaces permit communication between the two continuous internal volumes.

The baffle panel can extend to ends of the first and second panels and can terminate at the ends of the first and second panels. In such a configuration, the baffle panel is not joined to the side panels, and defines the spaces between the baffle panel and the side panels. The side panels can be identical to one another and can be symmetrical front to back.

An embodiment of a pillow cover includes first and second panels joined to one another at front and rear edges to form upper and lower surfaces and side panels joined to the first and second panels at their respective peripheries. The side panels each have enlarged end portions with a thinning middle section to define an hourglass shape. The enlarged end portions have a major dimension.

A baffle panel is joined to the first and second panels and extends between the side panels. The baffle panel has a height dimension less than the major dimension, the baffle panel being not joined to the side panels so as to define spaces between the baffle panel and the side panels. The first and second panels, the side panels and the baffle panel define two continuous internal volumes and the spaces between the baffle panel and the side panels permit communication between the two continuous internal volumes. The baffle panel maintains the pillow in an hourglass shape. The side panels can be symmetrical front to back.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
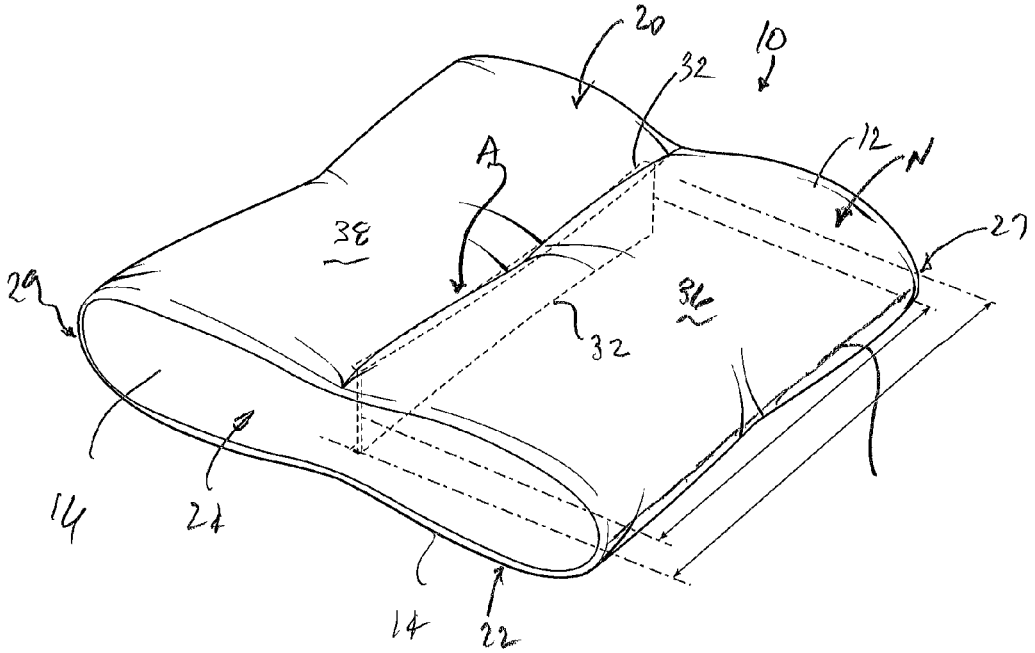
FIG. 1 is a perspective view of an example of an hourglass shaped pillow according to an embodiment disclosed herein, the pillow being shown with an internal baffle shown in phantom lines.
Figure 2:
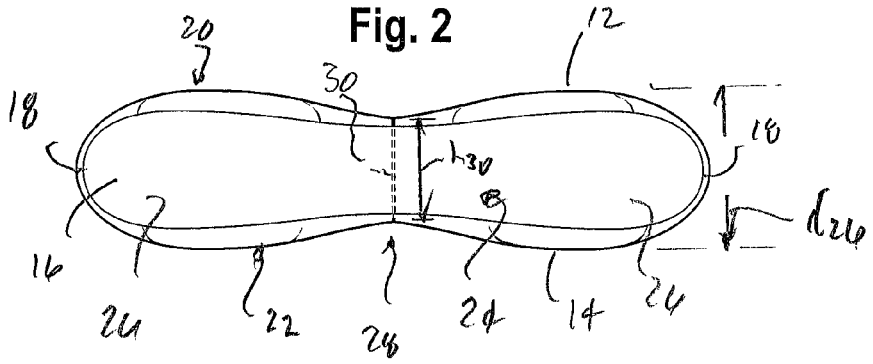
FIG. 2 is a side view of the pillow of FIG. 1, again showing the internal baffle panel in phantom lines.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 is a perspective view of a pillow 10 according to an embodiment described herein. The pillow 10 includes a first panel 12 and a second panel 14 (e.g., a top panel and a bottom panel) and a pair of side or gusset panels 16. The top and bottom panels 12, 14, are joined to one another, as by stitching, along end lines 18 to define a top 20 and a bottom 22 of the pillow 10. The gusset panels 16 are joined to the top and bottom panels 12, 14, also by stitching, to form sides 24 of the pillow 10. In an embodiment, as illustrated in the figures, the pillow 10 has an hourglass shape. That is, the sides 24 have enlarged ends 26 with a thinning middle section 28. The enlarged, hourglass ends 26 have a major dimension $d_{26}$. The top and bottom panels 12, 14, likewise curve around the front and rear of the pillow 10, and converge toward one another at the middle region 28 of the pillow 10 to further define the hourglass shape. The gusset panels 16 can be identical to one another and can be symmetrical, front 27-to-back 29 of the pillow 10. Alternately, the gusset panels 16 can be asymmetrical such that the front 27 or back 29 of the pillow 10 has a larger major dimension $d_{26}$ than the other.

As seen in the figures, the pillow 10 includes a central baffle panel 30. The baffle panel 30 extends from the top panel 12 to the bottom panel 14 and is joined to each by, for example, stitching as indicated at 32. The stitching 32 extends toward, but not fully to, the gusset panels 16. That is, the baffle panel 30 is joined to the top and bottom panels 12, 14, but is not joined to the gusset panels 16. Alternately, the baffle panel 30 may be joined to the gusset panels 16, but only in part, so as to maintain openings or spaces 34 between two internal volume regions 36, 38 defined by the top and bottom panels 12, 14, the gusset panels 16 and the baffle panel 30.

Figure 3:
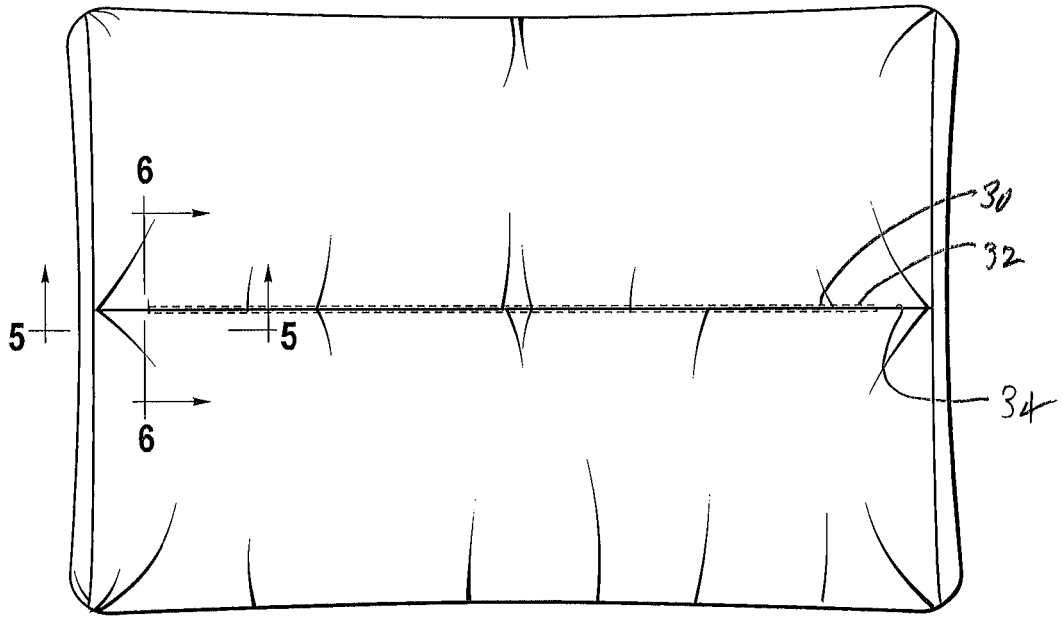
FIG. 3 is a top view of the pillow, the bottom view being similar thereto.
Figure 4:
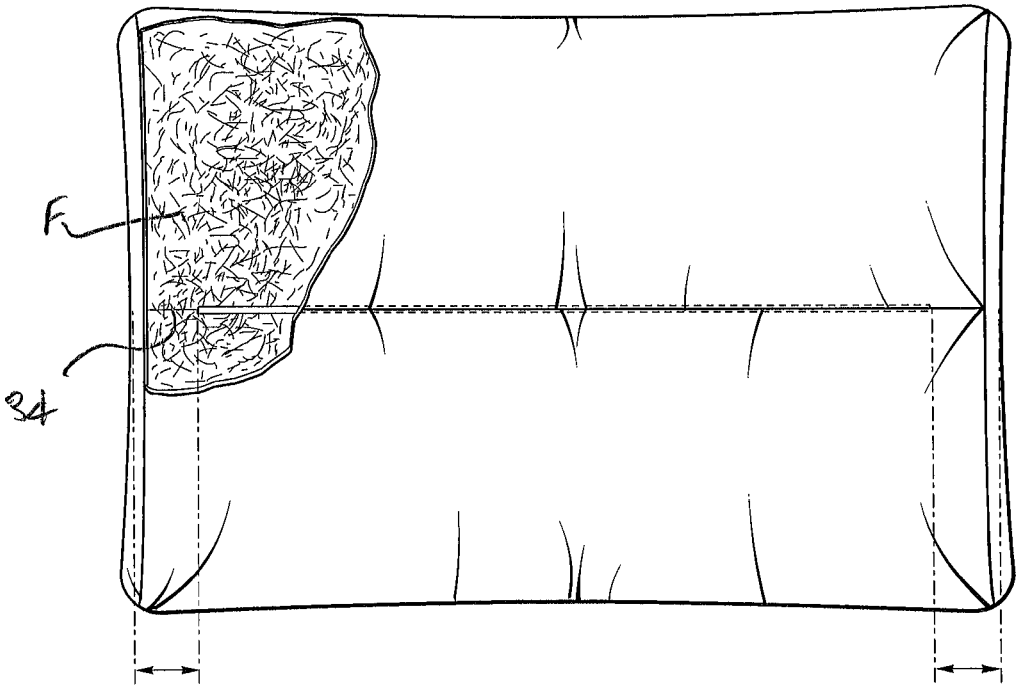
FIG. 4 is a view similar to FIG. 3, shown partially broken away to illustrate an example of the fill and the baffle panel.
Figure 5:
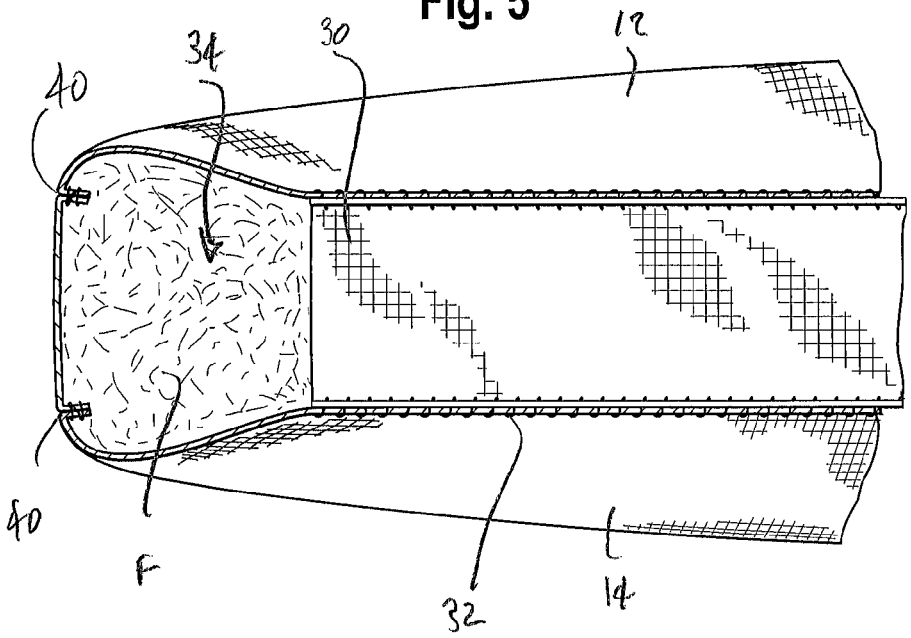
FIG. 5 is a partial sectional view taken along line 5-5 of FIG. 3.
Figure 6:
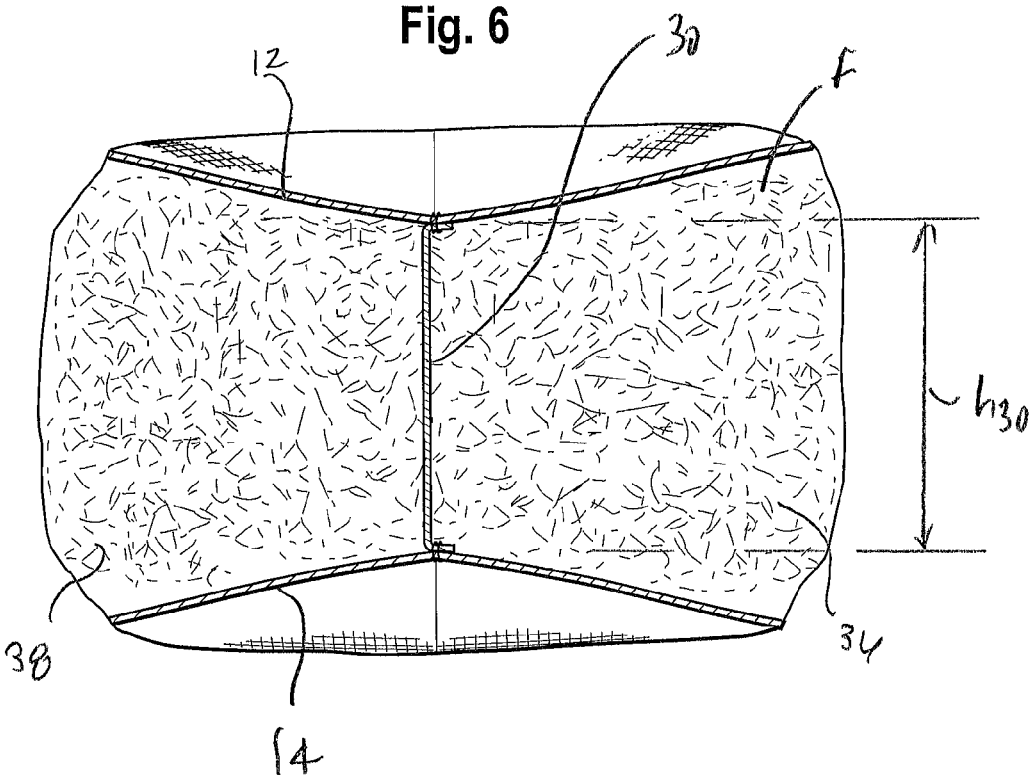
FIG. 6 is a partial sectional view taken along line 6-6 of FIG. 3.

Viewed another way, the baffle panel 30 is joined to the top and bottom panels 12, 14, to define the two separate but continuous internal volume regions 36, 38. In an embodiment, the baffle panel 30 may terminate spaced from the ends 40 of the top and bottom panels 12, 14, as seen in FIGS. 3 and 4. Alternately, the baffle panel 30 can extend fully between the top and bottom panels 12, 14. In both configurations, the baffle panel 30 is not joined to the gusset panels 16, thus defining the spaces or openings 34 between the baffle panel 30 and the gusset panels 16, to allow movement of fill F between the internal volumes 36, 38. Alternately still, the baffle panel 30 may be joined in part to the gusset panels 16, but may be joined in such a manner as to maintain the spaces or openings 34 between the internal volumes 36, 38.

It will be understood that the fill F can be a fiber fill, such as a polyester fiber fill, foam, shredded foam, feather, down or any other known fill material and combinations thereof. All such fill materials are within the scope and spirit of the present disclosure.

In an embodiment, the baffle panel 30 has a height $h_{30}$ that is less than a maximum height across the internal volumes (e.g., across the major dimension $d_{26}$ of the gusset panel 16). In such a configuration, the baffle panel 30 maintains the hourglass shape (the thinned middle section 28) by maintaining the top and bottom panels 12, 14, nearer to one another than at a location along the enlarged end sections 26. That is, the pillow 10 has a greater height within the internal volumes 36, 38 than at the partition between the internal volumes (as at the baffle panel 30).

It will be understood that any or all of the panels 12, 14, 16, 30 can be formed from a mesh material.

Importantly, the internal baffle 30 that creates the hourglass shape creates a nestling area A through the length of the pillow 10, between the top and bottom panels 12, 14 and the two hourglass gusset panels 16. This configuration holds the fill F in two separate compartments (the internal volumes 36, 38) so that the fill F stays in the important support area N under the user's neck. The fill F is allowed to move between the two volumes 36, 38, but only minimally, and not so much as to allow the fill F to bunch or collect in one volume 36 or 38 in favor of the other volume. This configuration provides a non-rectangular (hourglass) design, which has been found to provide ergonomic benefits in that it maintains support for the user's neck and provides a cradling or nestling area A for the user's head.

It will be appreciated by those skilled in the art that the relative directional terms such as top, bottom, sides, front, rear and the like are for explanatory purposes only and are not intended to limit the scope of the disclosure. All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing, it should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A pillow comprising: first and second panels joined to one another at front and rear edges to form upper and lower surfaces;

side panels joined to the first and second panels at their respective peripheries, the side panels each have enlarged end portions with only one thinning middle section to define an hourglass shape, the enlarged end portions having a major dimension;

a central baffle panel, separate from the first and second panels, joined to the first and second panels and extending between the side panels to create the thinning middle section of each side panel, the central baffle panel having a height dimension less than the major dimension, the thinning middle section of each side panel having a height dimension that is slightly greater than the height dimension of the central baffle panel but is less than the major dimension, and wherein the height dimension of the central baffle panel, the height dimension of each thinning middle section, and the major dimension of each enlarged end portion are all parallel to one another; and a fill material, wherein the first and second panels, the side panels and the central baffle panel define two continuous internal volumes and wherein the central baffle panel maintains the pillow in an hourglass shape.

2. The pillow of claim 1 wherein the central baffle panel is spaced from the side panels so as to define a space between the central baffle panel and the side panels.

3. The pillow of claim 1 wherein the central baffle panel extends to ends of the first and second panels.

4. The pillow of claim 3 wherein the central baffle panel terminates at the ends of the first and second panels and wherein the central baffle panel is not joined to the side panels so as to define spaces between the central baffle panel and the side panels.

5. The pillow of claim 1 wherein the fill material is a polyester.

6. The pillow of claim 1 wherein the side panels are identical to one another in an hourglass shape.

7. The pillow of claim 1 wherein the side panels are symmetrical front to back about a center line.

8. A pillow cover comprising:

first and second panels joined to one another at front and rear edges to form upper and lower surfaces;

side panels joined to the first and second panels at their respective peripheries, the side panels each have enlarged end portions with only one thinning middle section to define an hourglass shape, the enlarged end portions having a major dimension; and a central baffle panel, separate from the first and second panels, joined to the first and second panels and extending between the side panels to create the thinning middle section of each side panel, the central baffle panel having a height dimension less than the major dimension, the central baffle panel being not joined to the side panels so as to define spaces between the central baffle panel and the side panels, the thinning middle section of each side panel having a height dimension that is slightly greater than the height dimension of the central baffle panel but is less than the major dimension, and wherein the height dimension of the central baffle panel the height dimension of each thinning middle section, and the major dimension of each enlarged end portion are all parallel to one another;

wherein the first and second panels, the side panels and the central baffle panel define two continuous internal volumes, the spaces between the central baffle panel and the side panels permitting communication between the two continuous internal volumes and wherein the central baffle panel maintains the pillow in an hourglass shape.

9. The pillow cover of claim 8 wherein the central baffle panel extends to ends of the first and second panels.

10. The pillow cover of claim 9 wherein the central baffle panel terminates at the ends of the first and second panels.

11. The pillow cover of claim 8 wherein the side panels are identical to one another in an hourglass shape.

12. The pillow cover of claim 8 wherein the side panels are symmetrical front to back about a center line.

* * * * *